United States Patent [19]

Tsuzuki et al.

[11] 4,249,369

[45] Feb. 10, 1981

[54] CENTRALIZED CONTROL SYSTEM FOR OPEN END SPINNING MACHINES

[75] Inventors: Kanemitsu Tsuzuki, Kariya; Kozo Motobayashi, Kasuga; Kazuo Watanabe, Bisai; Yastami Kito, Kasuga; Shigeo Seko, Hino, all of Japan

[73] Assignees: Kabushiki Kaisha Toyoda Jidoh Shokki Seisakusho; Kabushiki Kaisha Meidensha, both of Japan

[21] Appl. No.: 73,639

[22] Filed: Sep. 10, 1979

[51] Int. Cl.[3] ..... D01H 15/02; D01H 1/244; D01H 13/16

[52] U.S. Cl. ..... 57/263; 57/81; 57/93; 57/100

[58] Field of Search ..... 57/261-265, 57/58.89-58.95, 92-94, 100, 81

[56] References Cited

U.S. PATENT DOCUMENTS

| | | | |
|---|---|---|---|
| 3,678,673 | 7/1972 | Prochazka et al. | 57/58.95 |
| 3,704,579 | 12/1972 | Tooka et al. | 57/263 |
| 3,780,513 | 12/1973 | Watanabe et al. | 57/93 |
| 4,033,107 | 7/1977 | Sasayama et al. | 57/81 |
| 4,100,722 | 7/1978 | Suzuki et al. | 57/263 |
| 4,109,450 | 8/1978 | Yoshida et al. | 57/263 |
| 4,159,616 | 7/1979 | Takeuchi et al. | 57/263 X |
| 4,163,359 | 8/1979 | Honjo | 57/93 |

*Primary Examiner*—John Petrakes
*Attorney, Agent, or Firm*—McGlew and Tuttle

[57] ABSTRACT

A centralized control system for open end spinning machines comprises a group control unit essentially consisting of a first spinning control means composed of a plurality of sequentially operated logical elements connected in series, the first spinning control means producing from the respective logical elements parallel outputs each of which is fed to a plurality of spinning units so as to control the spinning operation thereof, and an individual control unit essentially consisting of a second spinning control means each of which constituent is the same as the first spinning control means. A spinning mechanism includes a yarn breakage sensor provided in the stream of spun yarn, a driving means for driving the spinning mechanism including a plurality of driving motors, controlled by the output from the group or individual control unit. When there occurs no yarn breakage in any one of the plurality of spinning units, the spinning units are all controlled by group control unit, while when there occurs yarn breakage in any one of the plurality of spinning units, only the spinning unit in which yarn breakage is occured is shifted from the group control unit to the control of the individual control unit, and then after yarn breakage occured in the spinning unit is repaired, the spinning unit is for a second time shifted to the control of the group control unit.

7 Claims, 11 Drawing Figures

CENTRALIZED CONTROL SYSTEM FOR OPEN END SPINNING MACHINES

BACKGROUND OF THE INVENTION

The present invention relates to a centralized control system for open and spinning machines and, more particularly, to a control system for use in open and spinning machine of the type which is fully automated.

Open end spinning machines are presently in wide use to overcome various drawbacks which are inherent in the traditional spinning machine, providing outstandingly enhanced efficiency in the production of spun yarns. Numerous types of such open end spinning machines are being proposed in the art of textile fabrics production.

The open and spinning machine consists of a great number of, usually hundreds of spinning units which are arranged in a row on a common machine frame. Each of the spinning units comprises a combing roller having a peripheral surface formed with a number of projections which have, for example, saw-tooth configurations. A sliver of fibers to be spun is continuously fed by means of a sliver feed roller onto the toothed peripheral surface of the combing roller so that the fibers forming the sliver engage the projections of the combing roller. The combing roller is driven to rotate abouts its axis for opening up the sliver into fibers which are separate from each other. The separate fibers are then "doffed" or taken from the toothed peripheral surface of the combing roller and are forced into a rotary spinning chamber by a jet stream of air. The spinning chamber is driven to rotate about its axis so that the fibers are deposited onto an annular fiber-collecting area which is formed along the circumference of the spinning chamber. A yarn is thus continuously formed at the fiber-collecting area of the spinning chamber and is continuously withdrawn from the spinning chamber through a discharge opening which is located in line with the axis of rotation of the spinning chamber. The finished yarn is drawn away from this discharge opening by means of a set of draw-off rollers and is thereafter wound on a take-up roller into a suitable yarn package which may be in the form of a cheese as is customary in the art.

Each of the spinning units is provided with a sensor for detecting yarn breakage condition which may be invited in the spinning unit during operation. The yarn breakage sensor produces a signal in response to yarn breakage which is invited in the associated spinning unit so as to temporarily stop the particular spinning unit. The operational members of the spinning unit are then driven selectively and sequentially, whereupon servicing or repairing operation is conducted on the particular spinning unit for rejoining the broken yarn in the unit. During the servicing operation, the draw-off rollers and the take-up roller are first driven in reverse directions so that the yarn hanging down from the yarn package is fed back until the cut end of the yarn reaches the fiber-collecting area in the spinning chamber. The sliver feed roller, the combing roller and the rotary spinning chamber are then re-started so that a yarn is produced anew at the fiber-collecting area of the spinning chamber. The newly spun yarn is joined to the cut end of the previously spun yarn in the spinning chamber. When the yarn is thus re-joined, the draw-off rollers and the take-up roller are driven in usual directions for continuously withdrawing the yarn from the spinning chamber.

When the spinning unit is operating under proper conditions, the rotary members, especially the combing roller and the spinning chamber, of the unit are driven at extremely high speeds. For instance, the combing roller is driven at about 6,000 rpm and the spinning chamber driven at about 30,000 rpm. If such high speeds are maintained also during the servicing operation, almost prohibitorily exact control would be indispensable over the timings at which the individual rotary members of the spinning unit are sequentially initiated into action to proceed with the servicing operation. It is, therefore, a usual practice to have the rotary members of the spinning unit driven at speeds which are lower than usual operating speeds of the members so as to provide ample allowance between the timings at which the rotary members lending themselves to the yarn-rejoining operation are actuated.

The spinning units constituting a single open end spinning machine are in most cases driven by a common driving source through gearings or other suitable power transmission mechanisms which are respectively associated with the spinning units. When yarn breakage happens to take place in one of the spinning units, then the particular spinning unit is temporarily disconnected from the driving source in response to the signal from the yarn breakage sensor provided in the spinning unit and is connected for a second time to the driving source so as to receive the servicing operation. Since, in this instance, all the spinning units are driven by the same driving source and since the spinning unit in the yarn breakage condition must be driven at a reduced speed during the servicing operation as above noted, even the spinning units operating in proper conditions must be slowed down while the unit involving the yarn breakage condition in being serviced to restore the proper operational conditions. This apparently results in a considerable loss in the production efficiency of the machine as a whole and is accordingly unacceptable in today's textile fabrics production industry in which speeding up the production rate is one of the imperative requirements. Research and development efforts are thus being paid in various quarters of the industry in quest of advanced open and spinning machines which are cleared of the drawbacks above pointed out.

One of such advanced versions of open end spinning machines comprises a number of drive units each of which is exclusively associated with each of the spinning units constituitng the machine. The drive unit proper to one spinning unit operates independently of the drive units of the remaining spinning units and, thus, only the spinning units involving the yarn breakage condition can be slowed down during the servicing operation with the remaining spinning units kept driven at their usual operating speeds. If, in this instance, each of the drive units is provided with a control system which is proper to the particular unit, then it becomes necessary to have a great number of separate control systems incorporated in the spinning machine for controlling the hundreds of spinning units and the associated driving arrangements. Problems will then arise because of a tremendously increased cost of the spinning machine and a vast amount of human labor that will be required for the maintenance and servicing of the control systems. The present invention contemplates provision of an improved control system which is free from any of the drawbacks thus far pointed out.

It is, accordingly, an important object of the present invention to provide a centralized control system which is capable of controlling a great number of spinning units with enhanced efficiency.

It is another important object of the present invention to provide a centralized control system which is adapted to simultaneously control the spinning units in common modes of operation when the spinning units are operating under proper conditions and to yet control a limited number of spinning units independently of the remaining units when yarn breakage conditions are invited in the limited number of units.

It is, thus, still another important object of the present invention to provide a centralized control system which is predominant over the operations of all of the spinning units and which is nevertheless capable of functioning as if it were proper to one of or a limited number of spinning units when the unit or units are in the yarn breakage conditions.

It is still further important object of the present invention to provide a centralized control system wherein each spinning operation including servicing of yarn breakage is controlled and supervised by control commands from a group and an individual control units each including a plurality of sequentially operated logical elements and a braking unit, whereby the reliability of yarn rejoining operation can be extremely improved.

In accordance with the present invention, these and other objects are accomplished in a centralized control system comprising a group control unit essentially consisting of a first variable frequency power supply connected to a plurality of spinning units, a first spinning control means composed of a plurality of sequentially operated logical elements connected in series, the first spinning control means producing from the final-stage logical elements a command which is fed to the first power supply so as to increase the operational frequency of the power supply, the first spinning control means further producing from the respective logical elements parallel outputs each of which is fed to the spinning units so as to control the spinning operation thereof, an individual control unit comprising a second variable frequency power supply and a second spinning control means each of which constituent is the same as the first variable frequency power supply and the first spinning control means, the individual control unit further comprising a synchronizing detector producing an output when the operational frequency of the second power supply becomes equal to the operational frequency of the first power supply, a switching circuit for changing the control of the spinning unit in which the repair of yarn breakage has been effected from the individual control unit to the group control unit in response to the output of the synchronizing detector, and the plurality of spinning units each of which comprises a spinning mechanism for rendering sliver of fibers spun to form a spun yarn and taking up the spun yarn onto a take-up means, the spinning mechanism including a yarn breakage sensor provided in the stream of spun yarn, a driving means for driving the spinning mechanism including a plurality of driving motors, controlled by the output from the first or second variable frequency power supply, wherein there occurs no yarn breakage in any one of the plurality of spinning units, the spinning units are all controlled by the group control unit, while when there occurs yarn breakage in any one of the plurality of spinning units, only the spinning unit in which yarn breakage is invited is shifted from the group control unit to the control of the individual control unit, and then after yarn breakage invited in the spinning unit is repaired, the spinning unit is for a second time shifted to the control of the group control unit.

BRIEF DESCRIPTION OF THE DRAWINGS

The features and advantages of the centralized control system according to the present invention will become more apparent from the following detailed description taken in conjunction with the accompanying drawings, in which:

FIG. 5A shows a timing chart of a starting operation, FIG. 5D shows that of a servicing operation in the event that there occurs failure to repair yarn breakage during the servicing operation.

In these drawings, the same reference numerals indicate the same or similar elements of the centralized control system for the open and spinning machine according to the present invention.

DETAILED DESCRIPTION OF THE PREFERRED EMBODIMENT OF THE PRESENT INVENTION

Figure 1A:
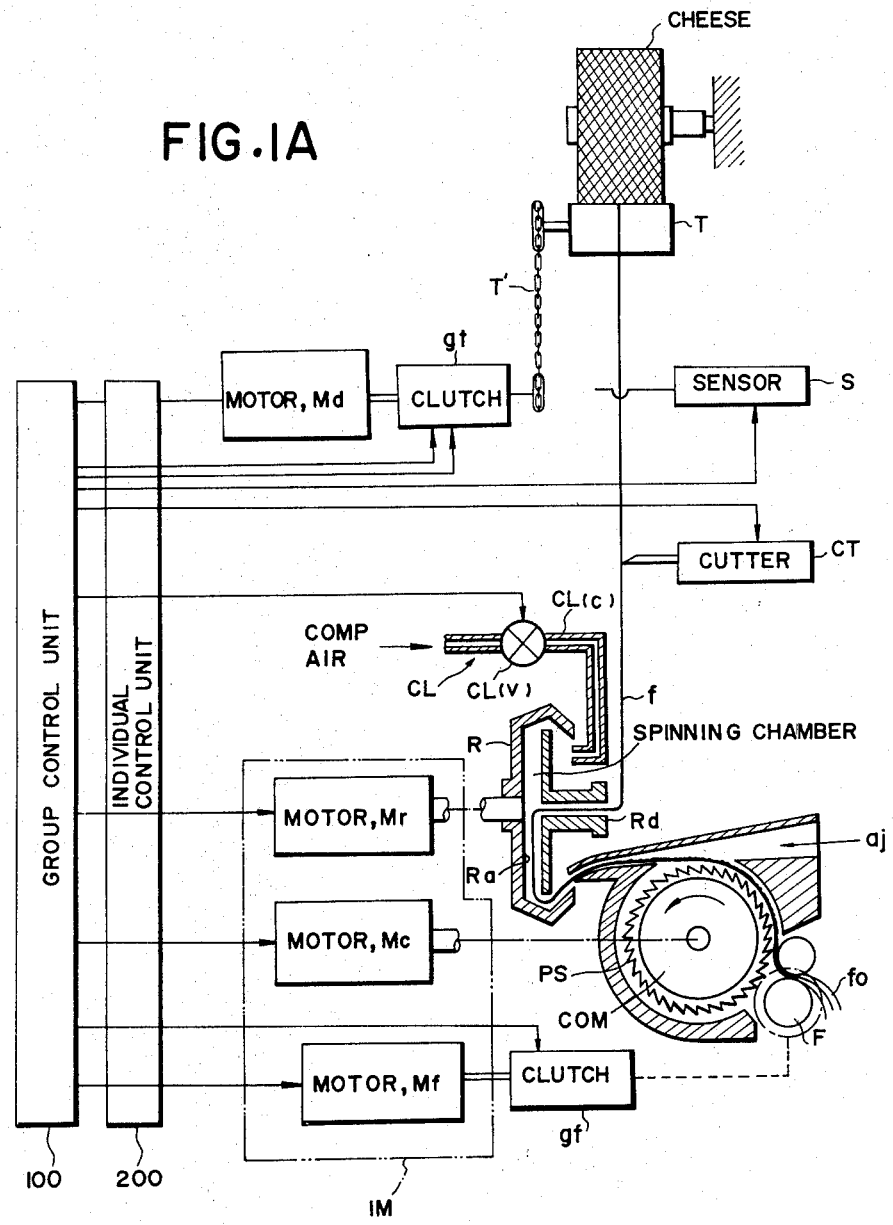
FIG. 1A is a view showing essential parts of a mechanical construction of a spinning unit and control units associated with the spinning unit in accordance with the present invention.

Reference will now be made to the drawings, and, in particular first to FIG. 1A which schematically illustrates a mechanical construction of a spinning unit of an open end spinning machine and control units associated therewith in accordance with the present invention. As previously mentioned, the open end and spinning machine consists of a large number of, usually hundreds of spinning units which are arranged in a row on a common machine frame. Each of the spinning units comprises a combing roller COM having a peripheral surface PS formed with a number of projections which have, for example, saw tooth configurations. A sliver of fibers $f_0$ to be spun is continuously fed by means of a sliver fed roller F onto the the toothed peripheral surface of the combing roller COM so that the fibers forming the sliver engage the projections of the combing roller COM. The combing roller COM is driven to rotate about its axis for opening up the sliver into fibers which are separate from each other. The separate fibers are then taken from the toothed peripheral surface PS of the combing roller COM and are forced into a rotary spinning chamber R by a jet stream of air $a_j$. The spinning chamber R is driven to rotate about its axis so that the fibers are deposited onto an annular fiber-collecting area Ra which is formed along the circumference of the spinning chamber R. A yarn is thus continuously formed at the fiber-collecting area Ra of the spinning chamber R and is continuously withdrawn from the spinning chamber R through a discharge opening Rd which is located in line with the axis of rotation of the spinning chamber R. The finished yarn designated by reference numeral f is drawn away from this discharge opening Rd which is located in line with the axis of rotation of the spinning chamber R. The finished yarn f is drawn away from this discharge opening Rd by means of a set of draw-off rollers (not shown) and is thereafter wound on a take-up roller T in a cheese. In addition to the aforementioned members, the spinning unit is provided with a sensor S for detecting a yarn breakage which may be invited in the spinning unit during operation. The yarn breakage sensor S produces a signal in response to a yarn breakage which is invited in the associated spinning unit so as to temporarily stop the particular spinning unit.

After a predetermined spinning work has finished, it is necessary to replace the cheese in which the spun yarn has been accumulated by a new empty cheese. For this purpose, provision of a means CT for cutting the spun yarn stretched between the cheese and the spinning chamber R is replaced. At the starting operation of each spinning cycle which will be referred to later in more detail, the cutting means CT is driven by such as an electro-magnetic relay (not shown).

The spinning unit further comprises a cleaning mechanism CL which feeds a compressed-air into the rotary spinning chamber R to blow off the waste fibers attached on the inner surface of the rotary spinning chamber R, wherein a conduit Cl(C) through which the compressed-air is introduced is provided with a magnetic solenoid value Cl(V) for adjusting the amount of the compressed-air.

Reference is now made to a driving mechanism for the aforementioned spinning members of the spinning unit. The sliver feed roller F is driven by an electric motor $M_f$ through an one way clutch $g_f$. The coming roller COM and the rotary spinning chamber R are directly driven by electric motors $M_c$ and $M_r$, respectively. These motors $M_f$, $M_c$, and $M_r$ are controlled in a predetermined ratio of speeds. Accordingly, these motors $M_f$, $M_c$ and $M_r$ will be called hereinafter "a motor group" collectively designated by reference numeral IM. The take-up roller T is driven by an electric motor $M_d$ through a reversible clutch $g_t$ and a transmission means T'.

These driving mechanism together with the yarn breakage sensor S, the cutting means CT and the magnetic valve CL(V) are controlled by control commands from a group control unit 100, an individual control unit 200 and a braking unit 300 although not shown in FIG. 1A.

Figure 1B:
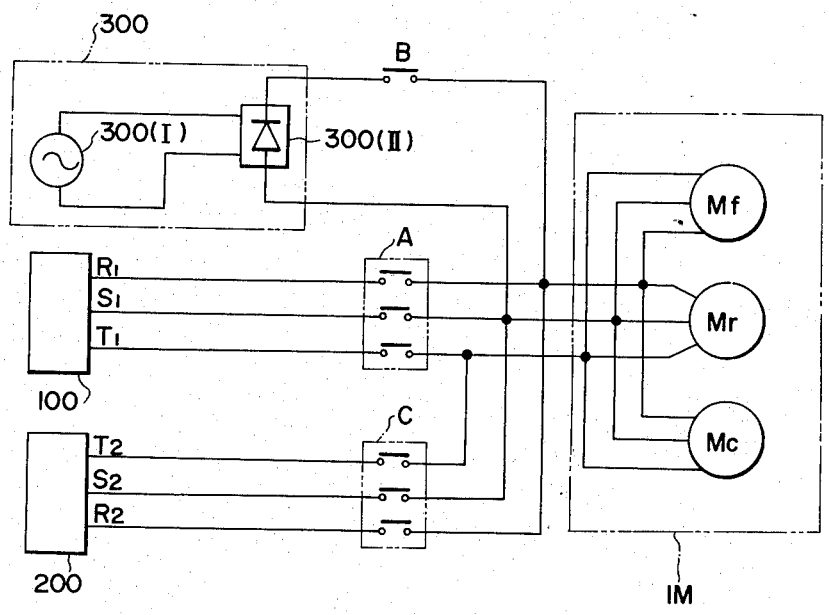
FIG. 1B is a block diagram schematically illustrating an electrical connection of the the system shown in FIG. 1A.

For convenience of an explanation, in FIG. 1A, a braking unit is omitted. However, in fact, as shown in FIG. 1B, the system according to the present application further comprises a braking unit 300 in addition to the group control unit 100 and the individual control unit 200, where 300(I) is a A.C. power supply and 300(II) is a rectifier for rectifying the alternating current fed from the A.C. power supply.

The driving motor group IM is connected to the group control unit 100 and the individual control unit 200 through three-phase bus lines $R_1$, $S_1$, $T_1$ and $R_2$, $S_2$, $T_2$, respectively. Normally open contacts collectively designated by reference numerals A and C are included in the bus lines $R_1$, $S_1$, $T_1$ and $R_2$, $S_2$, $T_2$, respectively. The anode and cathode of the rectifier 300(II) corresponding to the output terminals of the braking unit 300 are connected respectively to any two bus lines of the three-phase bus lines (R, S, T), for example, R-phase and S-phase thereby to apply DC power to the driving motor group IM to cause a dynamic braking operation to be also referred to later.

For the purpose of realizing this action, a normally open contact designated by reference numeral B is included between the cathode of the rectifier 300(II) and the common junction of the bus lines $R_1$ and $R_2$.

Figure 3:
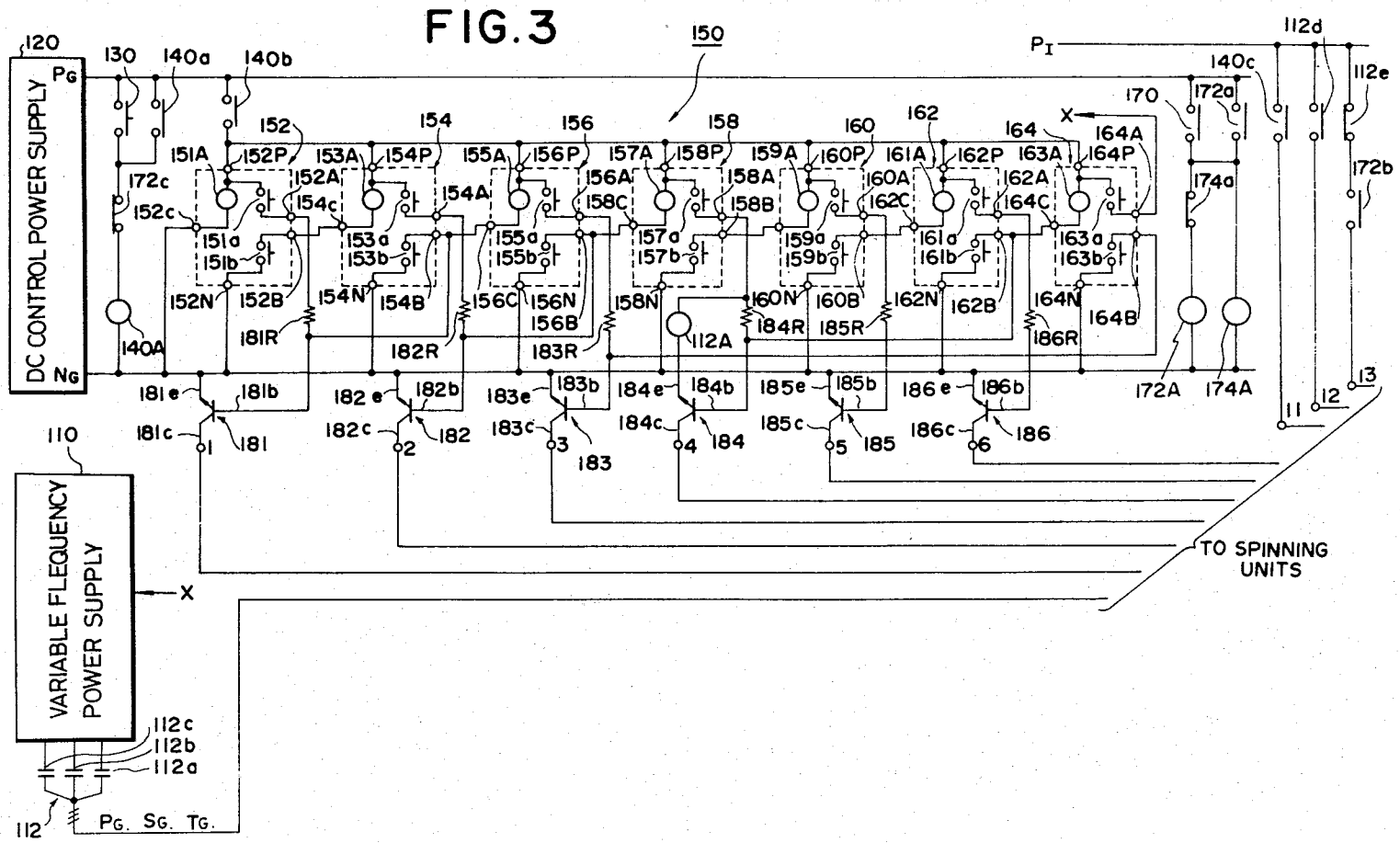
FIG. 3 is a circuit construction illustrating a detail of the group control unit shown in FIGS. 2A and 2B.

Referring to FIG. 3 illustrating a circuit construction of the group control unit 100, a variable frequency power supply 110 is connected to a plurality of spinning units 400(I)–400(*n*) to be described later through bus lines $R_G$, $S_G$, $T_G$. Normally open main contacts 112*a*, 112*b*, and 112*c* of a relay coil 112A to be referred to later in more detail are included in the bus lines $R_G$, $S_G$, $T_G$, respectively. Reference numeral 120 denotes a D.C. control power supply. Between a positive terminal $P_G$ and a negative terminal $N_G$ of the D.C. control power supply 120, a series curcuit is connected, which comprises a starting push button switch 130, a normally closed contact 172*c* of a relay coil 172A to be explained later and a starting relay coil 140A. A normally open contact 140*a* is connected in parallel with the push button switch 130, which serves as a self-maintaining contact of the relay coil 140A.

Reference numeral 150 denotes a first spinning control means composed of seven stages of sequentially operated logical elements. The spinning control means 150 is capable of producing from the final-stage logical element a command designated by reference numeral X which is fed to the power supply 110 so as to increase the operational frequency of the power supply 110. The spinning control means 150 is capable of further producing from the respective logical elements parallel outputs each of which is fed to the spinning units 400(I)–400(*n*) so as to control the spinning operation thereof. Reference numeral 140*b* denotes a normally open contact of the starting relay coil 140A, which contact connects the spinning control means 150 to the positive terminal $P_G$ of the D.C. power supply 120 when the starting relay coil 140A is energized.

More particularly, logical elements designated by reference numerals 152, 154, 156, 160, 162 and 164 are all the same circuit construction. Accordingly, reference is first solely made to the first-stage logical element 152 which comprises a timer relay coil 151A connected between the positive terminal 152P and a control input terminal 152C, a first normally open contact 151*a* of the relay coil 151A connected between the positive terminal 152P and a first output terminal 152A, and a normally open second contact 151*b* of the relay coil 151A connected between a negative terminal 152N and a second output terminal 152B. It is to be noted that the control input terminal 152C of the first-stage logical element 152 is connected together with the negative input 152N to the negative terminal $N_G$ of the D.C. power supply 120 while the control input terminals (154C–164C) of the subsequent logical elements (154–164) are connected to second input terminals (152B–162B) of the corresponding directly preceding logical elements, respectively. Reference numerals 181–186 denote driver transistors for operating a relay coil group 80 to be referred to later in more detail. Each emitter electrode of the driver transistors 181–186 is connected to the negative terminal $N_G$ of the D.C. control power supply 120, the collector electrode of transistors 181–186 being connected to the corresponding ends of the relay coils 81–86 through terminals 1–6, respectively. The base electrodes of the driver transistors 181–186 are connected to the first output terminals 152A–162A of the corresponding logical elements 152–162 except for the final-stage logical element 164 through base resistors 181R–186R, respectively. The second output terminal 154B of the second-stage logical element 154 is connected to the common junction of the base electrode 181*b* of the driver transistor 181 and the base resistor 181R. The second output terminal 156B of the logical element 156 is connected to the common junction of the base electrode 182*b* of the driver transistor 182 and the base resistor 182R. Between the first output terminal 158A of the fourth-stage logical element 158 and the negative terminal $N_G$ of the D.C. control power supply 120, there is a relay coil 112A for operating contacts 112*a*, 112*b* and 112*c* mentioned above. The second output terminal 162B of the sixth-stage logical element 162 is connected to the common junction of the base electrode 184*b* of the driver transistor 184 and the base resistor 184R. The second output terminal 164B of the final-stage logical element 164 is connected to the common junction of the base electrode 183*b* of the driver transistor 183 and the base resistor 183R.

Reference numeral 170 denotes a stopping push button switch. A normally closed contact 174*a* of a timer relay coil 174A to be referred to later in more detail and a braking relay coil 172A are connected in series together with the stopping push button switch 170 between the positive and negative terminals ($P_G$, $N_G$) of the D.C. control power supply 120. A normally open contact 172*a* serving as a self-maintaining contact of the braking relay coil 172A is connected in parallel with the stopping push button switch 170. The timer relay coil 174A is connected in parallel with the series circuit comprising the contact 174*a* and the relay coil 172A. Between a positive terminal $P_I$ of a D.C. control power supply 220 provided in an individual control unit 200 to be referred to later in more detail and a terminal 11, there is a normally open contact 140*c* of the starting relay coil 140A.

Between the positive terminal $P_I$ and a terminal 12, there is a normally open contact 112*d* of the relay coil 112*a*. Between the positive terminal $P_I$ and a terminal 13, a series circuit comprising a normally closed contact 112*e* of the relay coil 112A and a contact 172*b* of the relay coil 172B is connected.

Figure 4A:
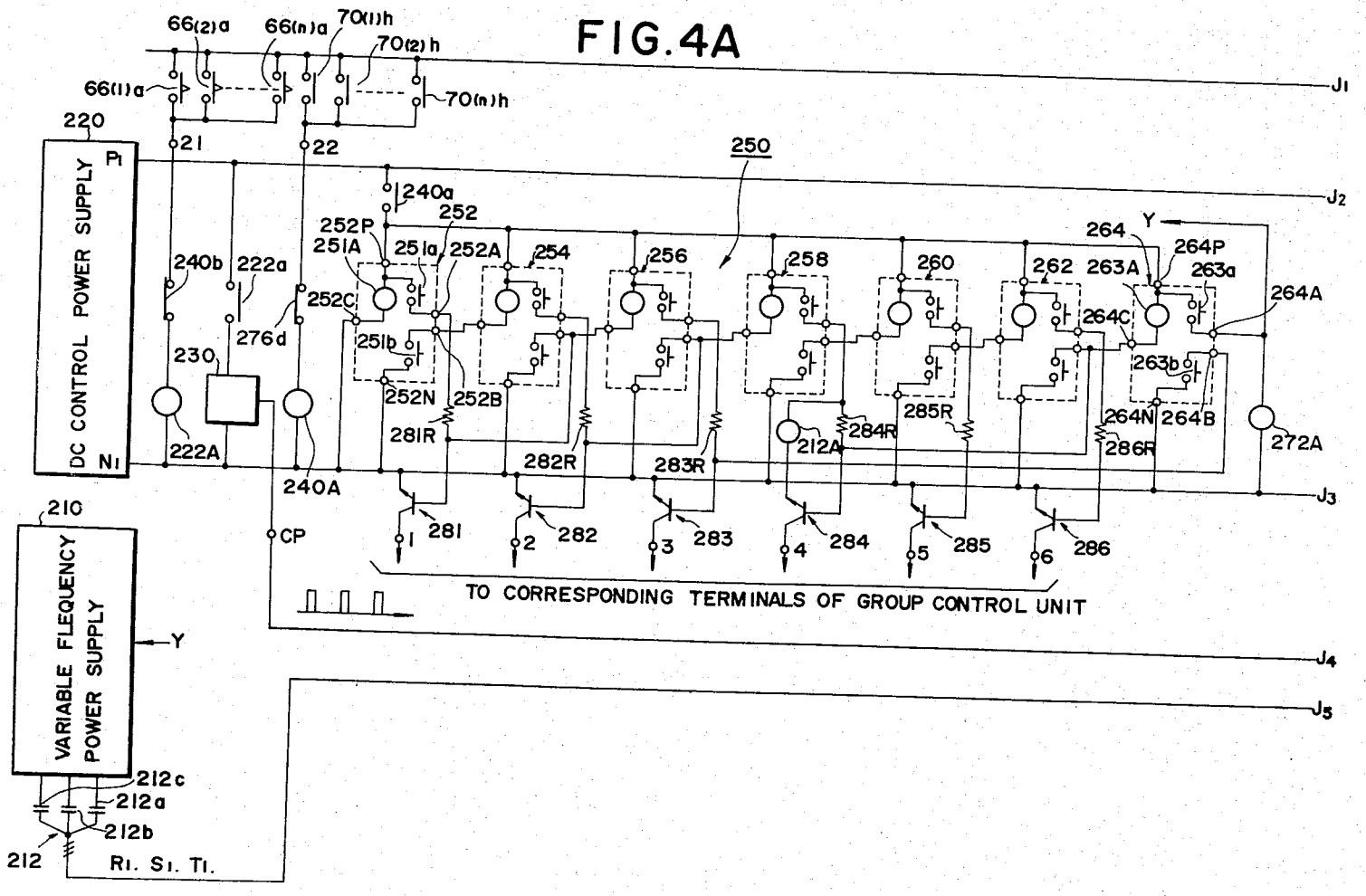
FIGS. 4A and 4B are circuit constructions illustrating a detail of the individual control unit shown in FIG. 2A.
Figure 4B:
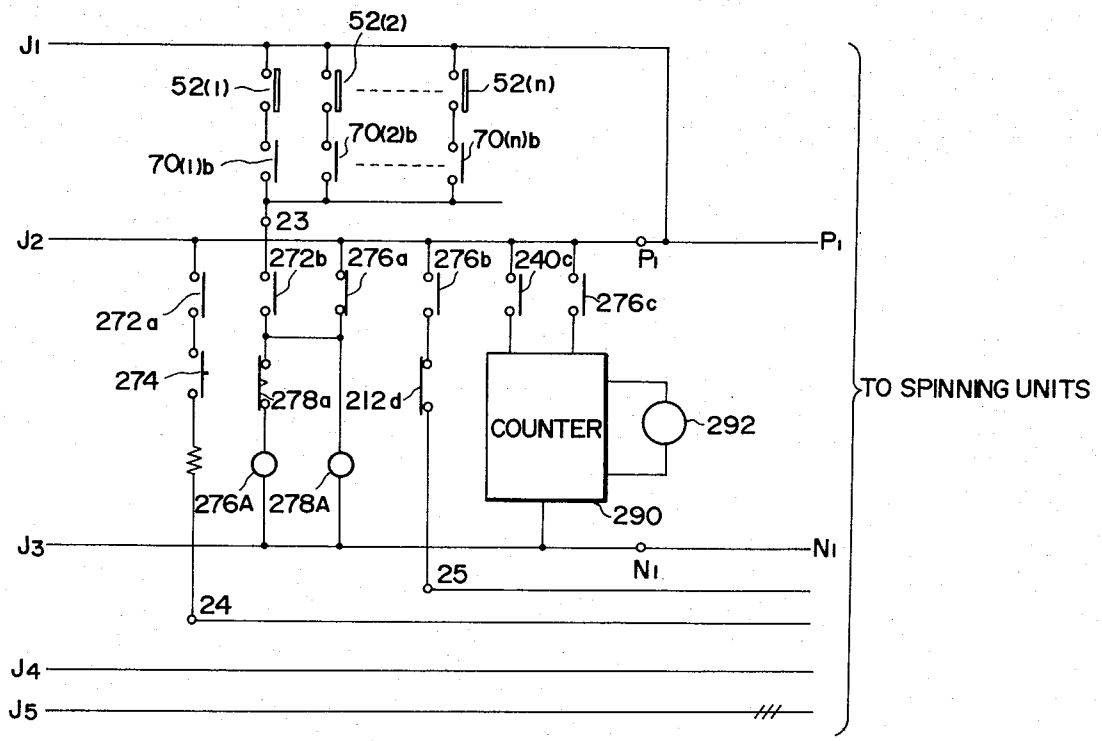

FIGS. 4A and 4B illustrate a circuit construction of the individual control unit 200. Bus lines labeled by symbols $J_1$–$J_5$ shown in FIG. 4A are respectively connected to the corresponding bus lines labeled by symbols $J_1$–$J_5$ shown in FIG. 4B. A variable frequency power supply 210 is connected to the plurality of spinning units **400(1)–400(*n*) through main contacts 212***a*, 212*b* and 212*c* of a relay coil 212A to be referred to later in more detail by means of bus lines $R_I$, $S_I$, $T_I$, respectively. Reference numeral 220 denotes a D.C. control power supply. Between the positive terminal $P_I$ of the D.C. control power supply and a terminal 21, contacts 66(1)*d*–**66(*n*)***d* of respective relay coils **66(1)A–66(*n*)A to be referred to later in more detail provided in the spinning units 400(1)–400(*n*)** are connected in parallel with each other.

Between the positive terminal $P_I$ of the D.C. control power supply 220 and a terminal 22, contacts 70(1)*h*–**70(*n*)***h* of respective relay coils **70(1)A–70(*n*)A to be referred to later in more detail provided in the spinning units 400(1)–400(*n*), are connected in parallel with each other. Between the terminal 21 and a negative terminal $N_I$ of the D.C. control power supply 220, a series circuit comprising a normally closed contact 240***b* of a relay coil 240A to be referred to later in more detail and a relay coil 22A is connected. Between the positive terminal $P_I$ and the negative terminal $N_I$ of the D.C. control power supply 220, a series circuit is connected, which comprises a normally open contact 222*a* of the relay coil 222A and a pulse signal generator 230 of which output is sequentially fed to each of control circuits to be referred to later in greater detail provided in the spinning units.

Between the terminal 22 and the negative terminal $N_I$ of the D.C. control power supply 220, a series circuit is connected, which comprises a normally closed contact 276*d* of a braking relay coil 276A to be referred to later in more detail, and a starting relay coil 240A.

Reference numeral 250 denotes a second spinning control means composed of seven stages of sequentially operated logical elements. The spinning control means 250 is capable of producing from the final-stage logical element a command designated by reference numeral Y which is fed to the power supply 210 so as to increase the operational frequency of the power supply 210. The spinning control means 250 is capable of further producing from the respective logical elements parallel outputs each of which is fed to the spinning unit **400(l)–400(*n*) so as to control the starting state of the spinning operation thereof during which operation the repair of yarn breakage is effected, as will be referred to later in more detail. Reference numeral 240***a* denotes a normally open contact of the starting relay coil 240A, which contact connects the spinning control means 250 to the positive terminal $P_I$ of the D.C. power supply 220 when the starting relay coil 240A is energized.

The circuit construction of each of logical elements (252–264) constituting the second spinning control means 250 is the same as that of each of the respective logical elements (152–164) constituting the first spinning control means 150. Accordingly, respective reference numerals attached to the logical elements and the associated circuit elements of the second spinning control means 250 denote corresponding components of the logical elements of the first spinning control means 150 and the associated circuit elements thereof stated above. Between the first output 258A of the fourth logical element 258 and the negative terminal $N_I$, a relay coil 212A for operating contacts 212*a*, 212*b*, 212*c* is connected. Between the first output terminal 264A and the negative terminal $N_I$ of the D.C. control power supply 220, a relay coil 272A is connected. Between the positive terminal $P_I$ of the D.C. control power a supply 220 and a terminal 24, a series circuit is connected, which comprises a normally open contact of the relay coil 272A and a synchronizing detecting means 274 which is closed when the operational frequency of the power supply 210 becomes equal to the predetermined operational frequency of the power supply 110.

Between a terminal 23 and the negative terminal of the D.C. control power supply 220, a series circuit is connected, which comprises a normally open contact 272*b* of the relay coil 272A, a normally closed contact 278*a* of a relay coil 278A to be referred to later in more detail and a braking relay coil 276A. A normally open contact 276*a* is connected in parallel with the contact 272*b*, which serves as a self-maintaining contact of the braking relay coil 276A. A timer relay coil 278A is connected in parallel with the series circuit comprising the contact 278*a* and the relay coil 276A. Between the positive terminal $P_I$ of the D.C. power supply 220 and a terminal 25, a series circuit is connected, which comprises a normally open contact of the relay coil 276A and a normally closed contact 212*d* of the relay coil 212A. Reference numeral 290 denotes a presettable counter for counting the number of yarn breakages, the counter being connected between the positive and negative terminals $P_I$, $N_I$ through a normally open contact 240*c* of the relay coil 240A and a contact 276*c* of the relay coil 276A, wherein contacts 240*c* and 276*c* are connected in parallel with each other. The counter 290 is provided with an alarm 292 which becomes operative when the number of yarn breakage counted by the counter 290 reaches a predetermined value.

Figure 2A:
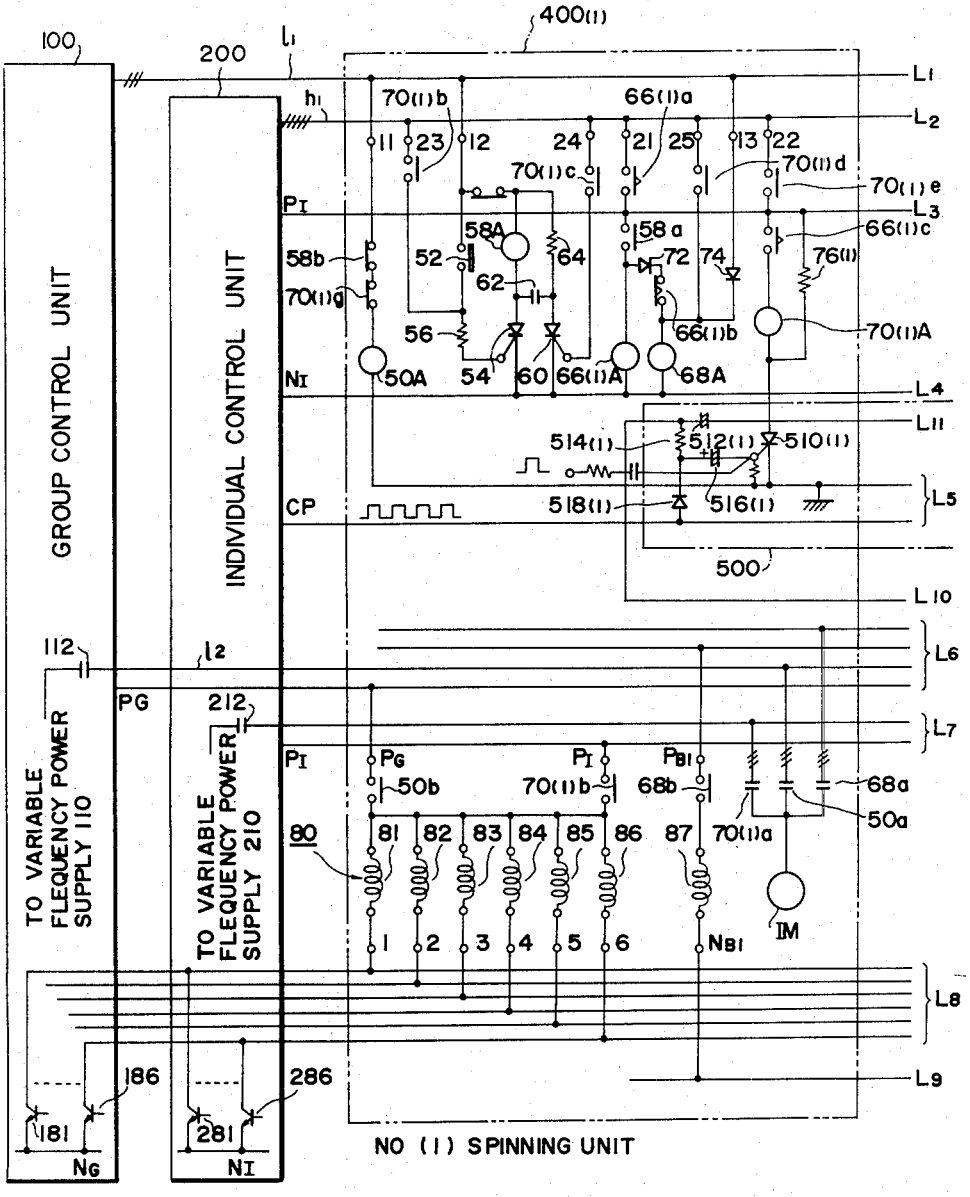
FIGS. 2A and 2B are circuit constructions illustrating electrical connection between a group control unit, an individual control unit and respective spinning units according to the present invention.
Figure 2B:
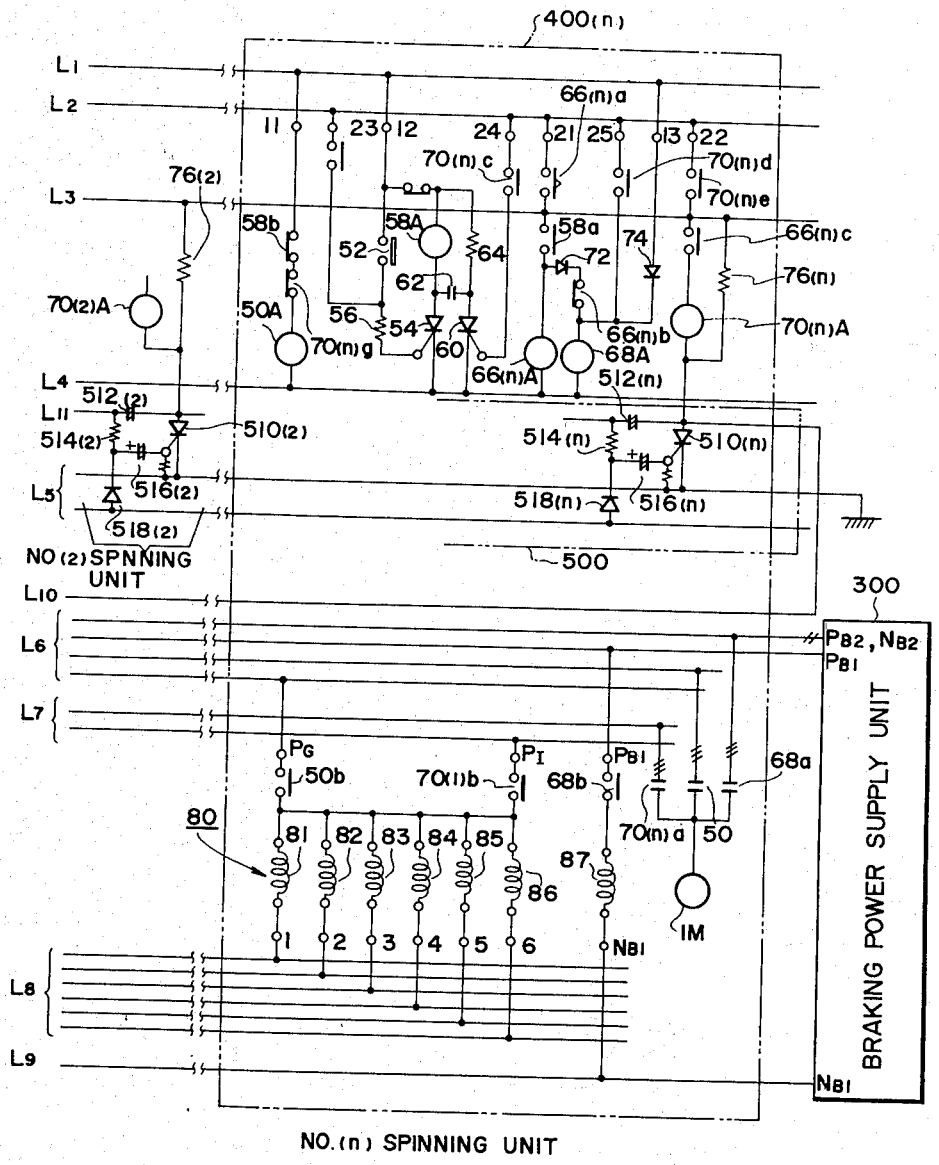

FIGS. 2A and 2B illustrates a circuit construction of the plurality of spinning units **400(1)–400(*n*). Since each of the spinning units 400(1)–400(*n*) has the same circuit construction, reference is made to, for example, No. (1) spinning unit. The suffix in parenthesis of the reference numeral attached to each spinning unit denotes number of corresponding spinning units. It is further noted that bus lines labeled by symbols $L_1$–$L_{11}$ shown in FIG. 2A are respectively connected to the corresponding bus lines labeled by symbols $L_1$–$L_{11}$ shown in FIG. 2B**.

The relay coil group 80 mentioned above, serves as a control means for controlling or operating the spinning mechanism shown in FIG. 1A. The relay coil group 80 consists of a cutting means driving relay coil 81, a cleaning mechanism driving relay coil 82, a yarn breakage sensor reset relay coil 83, a take-up roller reverse-rotating relay coil 84, a feed roller driving relay coil 85, and a take-up roller usual-rotating relay coil 86. Relay coils 81, 82, 83, 84, 85, and 86 constituting the relay coil group 80 are each at one end thereof commonly connected to the positive terminal $P_G$ of the D.C. control power supply 120 through a normally open contact 50*b* of a relay coil 50A to be referred to later in more detail, and to the positive terminal $P_I$ of the D.C. control power supply 220 through a normally open contact 70(1)*f* of a relay coil 70(l)A to be also referred to later. The relay coils 81–86 are each at the other end thereof connected to terminals 1 to 6, respectively. Since terminals 1 to 6 are connected to the collector electrodes of driver transistors (181–186; 281–286), respectively, corresponding coils (81–86) are respectively energized when driver transistors become conductive in response to the parallel outputs from the first output terminals (152A–162A; 252A–262A) of the respective logical elements (152–162; 252–262).

Between a positive terminal $P_{B1}$ and a negative terminal $N_{B1}$ of the braking unit 300, a series circuit is connected, which comprises a normally open contact 68*b* of a relay coil 68A to be referred to later in more detail and a braking coil 87. The driving motor group IM previously mentioned is connected to the power supply 210 of the individual control unit 200 through a normally open contact 70(1)*a* of a relay coil 70(1)A to be referred to later in more detail, to the power supply 110 of the group control unit 100 through a normally open contact 50*a* of a relay coil 50A to be referred to later in more detail, and to the terminals $P_{B2}$, $N_{B2}$ of the braking unit 300 through a normally open contact 68*a* of the relay coil 68A, respectively.

Between the terminal 11 connected to the group control unit 100 and the negative terminal $N_I$ of the individual control unit 200, a series circuit is connected, which comprises a normally closed contact 58*b* of a relay coil 58A to be referred to later, in more detail, a normally closed contact 70(1)*g* of the relay coil 70(1)A, and the relay coil 50A. Between the terminal 12 connected to the group control unit 100 and a gate of a thyristor (SCR) 54 to be referred to later in more detail, a series circuit is connected, which comprises a yarn breakage sensor switch 52 which is responsive to the output of the sensor S shown in FIG. 1A and a resistor 56. Between a terminal 23 connected to the individual control unit 200 and the common junction of the yarn breakage sensor switch 52 and the resistor 56 a normally open contact of a relay coil 70(1)A to be referred to later in more detail is connected. Between the terminal 12 and the negative terminal $N_I$ of the individual control unit 200, a series circuit is connected, which comprises a relay coil 58A and the SCR 54. A series circuit comprising a resistor 64 and a thyristor (SCR) 60 is connected in parallel with the series circuit comprising the relay coil 58A and the SCR 54. A commutation capacitor 62 is connected between the common junction of the relay coil 58A and the SCR 54 and the common junction of the resistor 64 and the SCR 60. Between the terminal 24 and the gate of the SCR 60, a normally open contact 70(1)*c* of the relay coil 70(1)A is connected, between a terminal 21 and the positive terminal $P_I$ of the individual control unit 200, a normally open contact 66(1)*a* of a timer relay coil 66(1)A to be referred to later in more detail is connected. Between the terminal $P_I$ of the individual control unit 200 and the negative terminal $N_I$ of the individual control unit 200, a series circuit is connected, which comprises a normally open contact 58*a* of the relay coil 58A and the timer relay coil 66(1)A. A series circuit comprising a diode 72, a normally closed contact 66(1)*b* of the timer relay coil 66(1)A, and a braking relay coil 68A is connected in parallel with the timer relay coil 66(1)A. Between the terminal 25 and the common junction of the contact 66(1)*b* and the braking coil 68A, a normally open contact 70(1)*d* of the relay coil 70(1)A is connected. Between the terminal 22 and the positive terminal $P_I$ of the individual control unit 200, a contact 70(1)*e* of the relay coil 70(1)A is connected.

Between the positive terminal $P_I$ and the negative terminal $N_I$ of the individual control unit 200, a series circuit is connected, which comprises a normally open contact 66(1)*c* of the timer relay coil 66(1)A and a relay coil 70(1)A, and a thyristor (SCR) 510(1) to be referred to soon.

Reference numeral 500 denotes an anode-connected thyristor type ring counter which operates and serves as a scanning circuit in response to the output of the pulse signal generator 230, wherein each of the stages of the ring counter 500 is alloted to spinning units **400(1)–400(*n*), respectively. In the first-stage of ring counter 500, 510(1) denotes the SCR, 512(1) a commutation capacitor, 514(1) a registor, 516(1) a gate trigger capacitor and 518(1) a diode. Clock pulses CP from the pulse signal generator 230 provided in the individual control unit 200 are fed to the anode of the diode 518(1)** as a shift pulse.

Reference is made to the detailed operation of the ring counter 500. A predetermined potential voltage appearing the positive terminal $P_I$ of the individual control unit 200 is applied to each of anode of SCRs **510(1)–510(*n*) through registors 76(1)–76(*n*). Accordingly, capacitors 516(1)–516(*n*) connected to the gates of SCRs 510(1)–510(*n*) are charged in polarity, as shown, up to an approximate power supply voltage through registors 514(1)–514(*n*), respectively. In such a condition, even if a shift pulse CP from the pulse signal generator 230 is applied to the anode of each diode 518(1) – 518(*n*), each SCR is not triggered. Accordingly, in order to cause the ring counter to operate, it is necessary to render, for example, the first-stage SCR 510(1) operative by applying a set pulse directly to the gate of the first-stage SCR 510(1) only during the starting time. Upon conduction of the SCR(1) by the set pulse, the anode of the SCR 510(1) becomes zero in potential level. As a consequence the electrode of the capacitor 512(2) on the side of the anode of the SCR 510(1) becomes zero in potential level. Simultaneously with this, the positive charge stored in the gate trigger capacitor 516(2) is discharged through the resistor 514(2). Accordingly, when the subsequent shift pulse CP is applied to the anode of each diode 518(1)–518(*n*), only the diode 518(2) becomes conductive whereby the capacitor 516(2) is charged to render solely the SCR 510(2)** conductive.

In the transient state during which the SCR 510(2) is conductive, the negative-going transient voltage signal is applied to the electrode of the commutation capacitor 512(2) on the side of the anode of the SCR 510(2), so that it will be transmitted to the opposite electrode of the commutation capacitor 512(2). As a consequence, a predetermined negative potential will occur at the opposite electrode of the commutation capacitor 512(2) since the negative-going signal stated above overlaps with the zero level at the anode of SCR510(1) which is caused by the conduction of the SCR 510(1). Accordingly, the SCR510(1) is inversely biased into nonconductive state. The commutation capacitor 516(2) is charged for a second time up to approximate power supply voltage whereby the SCR 510(2) is prevented from being retriggered even if a subsequent shift pulse is applied to the anode of the diode 518(2). Thus, the output state of the ring counter 500 will be cyclicly transferred according as the SCRs **510(1)–510(*n*) sequentially become conductive in accordance with the shift pulses from the pulse signal generator 230**.

OPERATION OF THE SYSTEM

In normal operation which yarn breakage is not invited, all spinning units **400(1)–400(*n*) are controlled by the group control unit 100, as understood from the preceding description. It is now assumed that FIG. 1A** shows that any one spinning cycle has finished wherein a spun yarn f is stretched between the take-up roller T and the spinning chamber R.

Figure 5A:
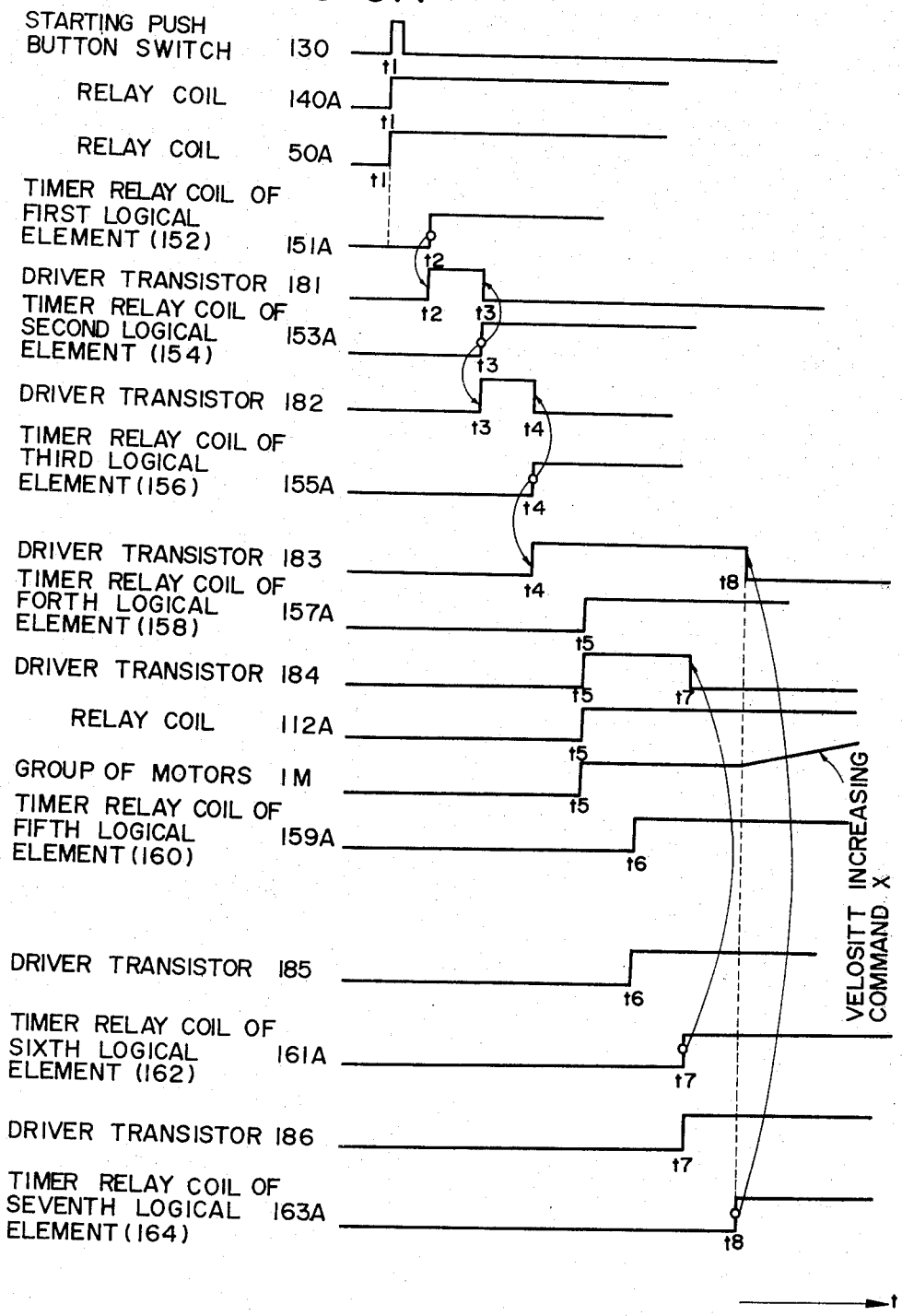
FIGS. 5A and 5D are timing charts of the system according to the present invention where
Figure 5B:
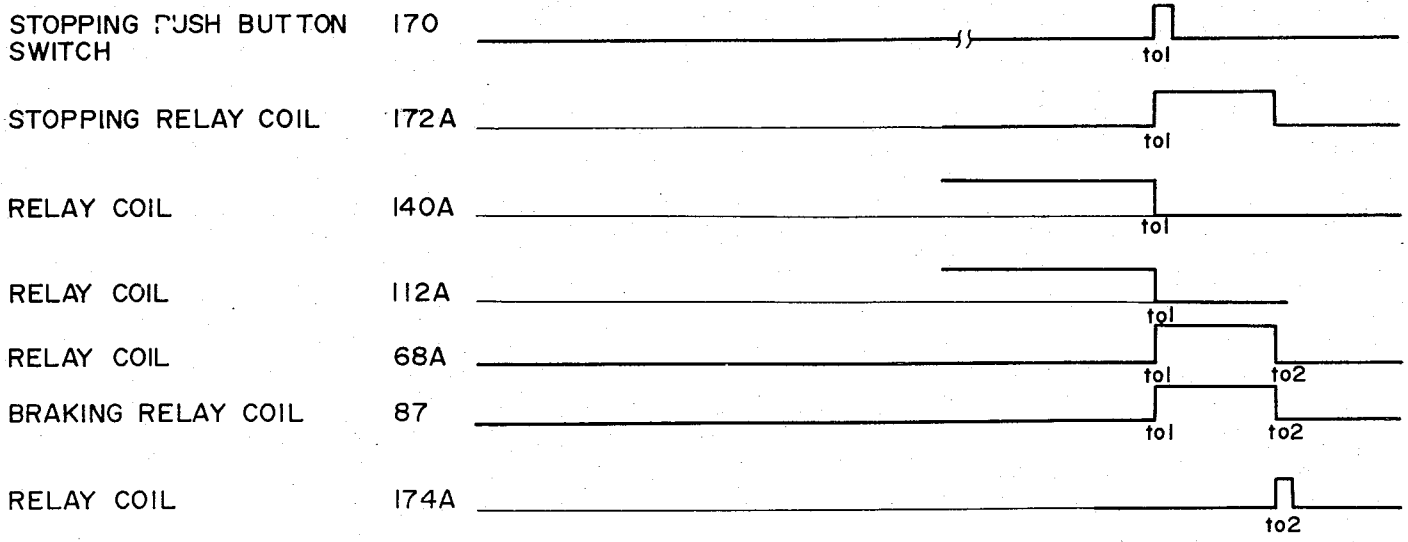
FIG. 5B shows that of a stopping operation.
Figure 5C:
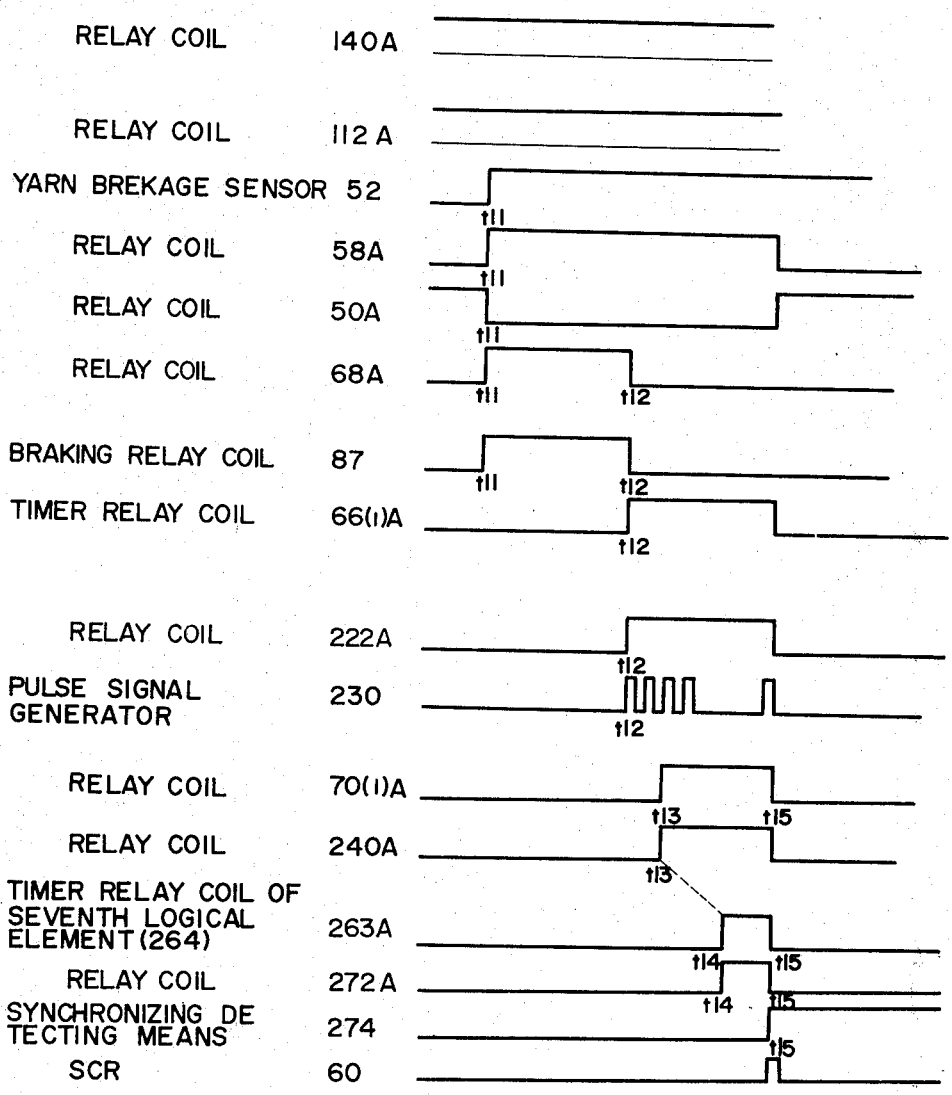
FIG. 5C shows that of a servicing operation of yarn breakage.

Reference is first made to the starting operation of the next spinning cycle of the sytem with reference to FIG. 5A. At a time $t=t_1$, when the starting switch 130 is closed, the relay coil 140A is energized thereby to close the self-maintaining contact **140*a*. At the same time, the contact 140*b* is also closed whereby the first-stage logical element 152 is connected to the positive terminal $P_G$ of the D.C. power supply 120. Also, at this time $t=t_1$, the contact 140*c* is closed so that the positive terminal $P_I$ of the D.C. power supply 220 is connected to the terminal 11. Accordingly, the relay coil 50A provided in each spinning unit 400(1)–400(*n*) is energized to close the contact 50*a* so that bus lines $R_G$, $S_G$, $T_G$ are connected to the motor group IM. Since the contact 50*b* is also closed by energization of the relay coil 50A, the positive terminal $P_G$ of the D.C. power supply 120 is connected to the one end of the relay coil group 80. However, since driver transistors 181 to 186 do not become conductive, the terminals 1 to 6 each of which is connected to the other end of the relay coil group 80 are not grounded, so that the relay coil group 80** is not energized.

Since the positive terminal $P_G$ of the D.C. power supply 20 is connected to the positive terminal 152P of the first-stage logical element 152, the timer relay coil 151A will be energized at a time $t=t_2$ after a predetermined time passes from $t=t_1$, so that contacts **151*a* and 151*b* are closed. Due to the closing of the contact 151*a*, D.C. power from the D.C. power supply 120 is supplied to the output terminal 152A of the first-stage logical element 152 through the positive terminals $P_G$ and 152P. As a result, a predetermined bias is applied to the base electrode 181*b* of the driver transistor 181 for the cutting means driving relay coil 81, so that the transistor 181** becomes conductive.

Accordingly, since the terminal 1 is connected to the negative terminal $N_G$ of the D.C. power supply 120, the relay coil 81 is energized, so that the cutting means CT shown in FIG. 1A becomes operative to cut the spun yarn f stretched between the take-up roller T and the spinning chamber R. Also, due to the closing of the contact **151*b*, the negative terminal $N_G$ of the D.C. power supply 120 is connected to the control input terminal 154C of the second-stage logical element 154 through the terminals 152B and 152N. Accordingly, the time relay coil 153A of the second-stage logical element 154 will be energized at a time $t=t_3$ after a predetermined time passes from $t=t_2$, so that contacts 153*a* and 153*b* are closed. As a result, the driver transistor 182 becomes conductive for the same reason as in the case of the first-stage logical element 152, so that the cleaning mechanism driving relay coil 82 is energized to render the cleaning means CL shown in FIG. 1A** operative. That is, the magnetic solenoid valve CL(V) is opened so that compressed air is introduced into the rotary spinning chamber R. The compressed air will blow off the waste fibers attached to the inner peripheral surface of the spinning chamber R, resulting in cleaning the inside of the spinning chamber R.

At this time $t=t_3$, the contact **153*b* of the second-stage logical element 154 is closed, so that the negative terminal $N_G$ of the D.C. power supply 120 is connected to the common junction of the base electrode 181*b* of the transistor 181 and the resistor 181R through terminals 154N and 154B. As a result, the transistor 181 becomes non-conductive to stop the operation of the cutting means CT. Next, at a time $t=t_4$, the timer relay coil 155A of the third-stage logical element 156 is energized to close the contact 155*a* so that the transistor 183 becomes conductive to energize the yarn breakage sensor reset relay coil 83** whereby a yarn breakage sensor reset means (not shown) becomes operative to place the sensor S in a temporary reset state.

At a time $t=t_5$, the timer relay coil 157A of the fourth-logical element 158 is energized to close the contacts **157*a* and 157*b*. By closing the contact 157*a*, the base of the transistor 184 is biased so that the transistor 24 becomes conductive. As a result, the negative terminal $N_G$ of the D.C. power supply 120 is connected to the terminal 4 to energize the take-up roller reverse-rotating relay coil 84. Accordingly, the reversible clutch $g_t$ becomes operative in a manner to transmit the reversed rotation of the motor Md to the take-up roller T, so that the take-up roller T reverses to pay out the yarn in the descending direction thereof near the discharge opening Rd of the spinning chamber R. At this time, $t=t_5$, the relay coil 112A is also energized so that the contacts 112***a*, 112*b*, and 112*c* provided on the side of the output of the variable frequency power supply 110 are closed. As a consequence, the motor group IM is connected to the variable frequency power supply 110 through bus lines $R_G$, $S_G$, $T_G$ since the contact 50*a* has been already closed as stated above. Accordingly, the motor group IM starts to revolve in the waiting state with fiber being not supplied.

At a time $t=t_6$, the relay coil 159A of the fifth-stage logical element 160 is energized to close the contacts 159*a* and 159*b*. Due to the closing of the contact 159*a*, the transistor 185 becomes conductive whereby the terminal 5 is grounded to energize the feed roller driving relay coil 85. Thus, the feed clutch $g_f$ becomes operative to transmit the rotation of the motor $M_f$ to the feed roller F thereby to feed sliver of fibers $f_o$ into the combing roller COM. As a result, the combing roller COM becomes operative to open up fibers $f_o$ and then will feed the fibers opened up together with jet air $a_i$ into the rotary spinning chamber R which is rotating at a high speed and serves as a twist imparting means. The spinning chamber R starts to spin the fibers attached to the collecting surface $R_a$ thereof and discharges the fibers as a spun yarn out of the discharge opening Rd. The discharged spun yarn is at its free end twisted together with and connected to the end of the yarn being suspended from the take-up roller T.

At a time $t=t_7$, the timer relay coil 161A of the sixth-stage logical element 162 is energized to close the contacts 161*a* and 161*b*. Due to the closing of the contact 161*b*, the transistor 184 will become conductive to stop the reversible winding operation of the clutch $g_t$. By closing the contact 161*a*, the transistor 186 becomes conductive whereby the terminal 6 is grounded to energize the take-up roller usual-rotating relay coil 86. Accordingly, the reversible clutch $g_t$ transmits the rotation of the motor $M_d$ to the take-up roller T so as to revolve in the winding direction.

At a time $t=t_8$, when a predetermined winding tension is produced in the yarn f, the timer relay coil 163A of the final-stage logical element 164 is energized to close the contacts 163*a* and 163*b*. Due to the closing of the contact 163*b*, the transistor 183 becomes non-conductive to deenergize the relay coil 83 whereby the operation of the yarn breakage sensor reset means becomes non-operative whereby the sensor S is set for a second time. Due to the closing of the contact 163*a* the command X for increasing the frequency is fed to the variable frequency power supply 110 thereby to step up the revolution velocity of the motor group IM.

As will be obvious from the foregoing description, in the steady state, in the event that there occurs no yarn breakage in any one of spinning units 400(1)–**400(*n*)**, all spinning units operates at a predetermined high speed with the yarn breakage sensor being kept non-operated.

Reference is now made to stopping operation of the system according to the present invention. At a time $t=t_{01}$, the stopping push button switch 170 shown in FIG. 3 is closed to energize the stopping relay coil 72A thereby to close the contacts 172*a* and 172*b* and open the contact 172*c*. Due to the opening of the contact 172*c*, the relay coil 140A is deenergized thereby to deenergize the relay coil 112A. Accordingly, the contacts 112*a*, 112*b* and 112*c* provided on the side of the output of the variable frequency power supply 110 are opened to disconnect the motor group IM from the group control unit 100. Because of deenergization of the relay coil 112A, the contact 112*e* is reverted to its closed condition. As a result, when the contact 172*b* is closed by energizing the relay coil 172A, the terminal 13 is connected to the positive terminal $P_I$ of the DC power supply 220 thereby to energize the relay coil 68A. Accordingly, the contact 68*a* is closed to connect the motor group IM to the terminals $P_{B2}$, $N_{B2}$ of the braking control unit 300.

As a consequence, as best shown in FIG. 1B, by flowing a D.C. current in any two of three phase buses, so called "dynamic braking" will be effected. At the same time, the braking coil 87 will be energized due to the closing of the contact 68*b*, thereby rapidly placing the motor group IM in the stopped condition. Then, the relay coil 172A is deenergized at a time $t=t_{02}$ after the predetermined time interval to release the braking action. Thus, stopping operation of the spinning unit is accomplished.

Reference is now made to the rejoining operation of yarn breakage which is invited in any one of spinning units 400(1)–**400(*n*) with reference to the time chart shown in FIG. 3C**.

In a proper condition, all spinning units are controlled by the group control unit 100 as stated above, in which condition the relay coils 140A and 112A are placed in the energized state and the motor group IM is controlled by the variable frequency power supply 110 to carry out a spinning operation.

It is assumed that, at a time $t=t_{11}$, there occurs yarn breakage in the No. (1) spinning unit. The yarn breakage sensor switch 52 will be closed. The SCR 54 becomes conductive in response to the output of the yarn breakage sensor switch 52 to energize the relay coil 58A thereby to close the contact 58*a* and open the contact 58*b*. Due to the opening of the contact 58*b*, the relay coil 50A is deenergized to open the contact 50*a*.

As a result, the motor group IM will be separated from the bus lines $R_G$, $S_G$, $T_G$ connected to the variable frequency power supply 110. By closing the contact 58*a*, the braking relay coil 68A is energized to close the contact 68*a* thereby to connect the terminals $P_{B2}$, $N_{B2}$ of the braking unit 300 to the motor group IM. By closing the contact 68*b*, the upper end of the braking relay coil 87 shown in FIG. 2A is connected to the positive terminal $P_{B1}$ of the braking unit 300 whereby the relay coil 87 is energized to brake the motor group IM according to the dynamic braking operation as understood from the foregoing description. At a time $t=t_{12}$, the relay coil 66(1)A is energized to open the contact 66(1)*b*. At the same time, the braking relay coil 68A is deenergized to open the contacts 68*a* and 68*b* thereby to release the braking operation. Since the contact 66(1)*d* of the braking relay coil 68A is closed, the relay coil 222A provided in the individual unit 200 is energized to open the contact 222*a*. Accordingly, the pulse signal generator 230 produces and delivers clock pulses to the ring counter 500 to shift the output state of its respective stages. In this condition, the contact 66(1)*c* is also closed in response to the energization of the relay coil 66(1)A.

If, at a time $t=t_{13}$, the SCR 510(1) of the ring counter 500, which is alloted to the No. 1 spinning unit, becomes conductive, the relay coil 70(1)A is energized to close the contact 70(1)*h* thereby to energize the relay coil 240A. As a result, the contact 240*a* is closed to connect the positive terminal $P_I$ to the logical element 250. As a result, in the same manner as the logical element 150 is operated, the logical element 250 is sequentially operated in accordance with the time constant of the timer relay assembled therein. Only the spinning unit in which the yarn breakage is invited is controlled by the individual control unit 200 independently of the group control unit 100 thereby to automatically service the yarn breakage: the broken yarns are rejoined in the same manner as a free end of the yarn suspended from the take-up roller T is twisted and connected to the spun yarn discharged from the spinning chamber R.

The logical elements 252–262 sequentially produces respective outputs and then the final-stage logical element 264 produces an output. This output from the final-stage logical element 264 serves as a command Y for increasing the frequency of the variable power supply 210 and also causes the relay coil 272A to be energized to close the contacts 272*a* and 272*b*. When the operational frequency (controlling the velosities of the motor group IM) of the power supply 210 of the individual control unit 200 becomes sychronized with the operational frequency of the power supply 110 of the group control unit 100, the synchronizing detecting means 274 is closed to connect the positive terminal $P_I$ of the D.C. power supply 220 to the terminal 24 thereby to render the SCR 60 conductive. Accordingly, in the transient state during which the SCR 60 is conductive, the negative-going transient voltage signal is applied to the electrode of the commutation capacitor 62 on the side of the anode of the SCR 60, so that it will be transmitted to the opposite electrode of the commutation capacitor 60. As a consequence, a predetermined negative potential will occur at the opposite electrode of the commutation capacitor 60 since the negative-going signal stated above overlaps with the zero level which is caused by the conduction of the SCR 54. Accordingly, the SCR 54 is inversely biased to be rendered non-conductive thereby to deenergize the relay coil 58A.

At this time, the relay coil 70(1)A is also deenergized to close the contacts 58*b* and 70(1)*g* for a second time thereby to energize the relay coil 50A. As a result, the motor group IM is for a second time connected to the variable frequency power supply 110 of the group control unit 100 through bus line $R_G$, $S_G$, $T_G$, so that all spinning units are controlled by the group control unit 100.

It is here noted that the SCR 60 is self-quenched as follows: After the SCR 54 is rendered nonconductive, a high voltage which may exceed the power supply voltage is produced at the anode of the SCR 54. At this time, provided the SCR 60 is held conductive, a oscillating current which is greately attenuated by the inductance of the relay coil 58A and the impedance of the registor 64 flows from the anode of the SCR 54 to the negative terminal $N_I$ through the SCR 60. Accordingly, the negative going signal of the oscillating current is transmitted to the electrode of the commutation capacitor 62 on the side of the anode of the SCR 60. As a consequence, a predetermined negative potential will occur at the electrode of the commutation capacitor 62 on the side of the SCR 60 since the negative-going signal stated above overlaps with the zero level which is caused by the conduction of the SCR 60. Accordingly, SCR 60 is inversely biased to be quenched or become non-conductive in a short time.

Figure 5D:
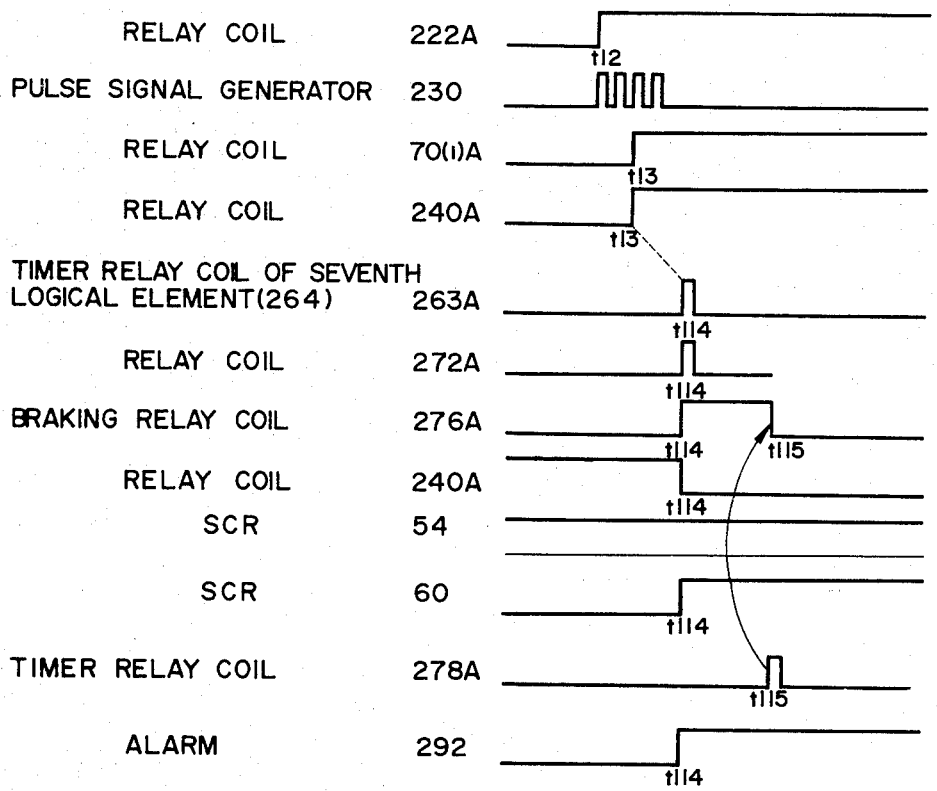

Referring to the time chart shown in FIG. 5D, reference is finally made to detection of yarn breakage for a second time as long as the repair of yarn breakage in the particular spinning unit is carried out under the control of the individual control unit as stated above.

At a time $t=t_{114}$, it is assumed that the final-stage logical element 264 of the individual control unit 200 produces an output. At this time $t=t_{114}$, the relay coil 272A is energized to close the contact 272*b* thereby to energize the braking relay coil 276A. Accordingly, the contact 276*d* is opened to deenergize the relay coil 240. At this time, $t_{114}$, the contact 276*b* is closed, so that the positive terminal $P_I$ of the D.C. power supply 220 is connected to the terminal 25 of the spinning unit to energize the braking relay coil 68A. As a result, the motor group IM is connected for a second time to the braking power supply unit 300. At the same time, the braking clutch driving relay coil 87 is energized to effect a dynamic braking until $t=t_{115}$ when the timer relay coil 278A produces an output and thereafter to repair yarn breakage for a second time.

The presettable counter 290 counts the frequencies of defective repair of yarn breakages, or the number of times of failure to repair yarn breakages wherein when the number of times of the failure counted exceeds a predetermined value, the counter 290 renders the alarm 292 operative. Thus, operators can recognize that the yarn breakage is not one which may be usually invited in the spinning units but one which is attributed to the defective operation of the particular spinning unit. If the spinning units are running under the condition that solely the particular spinning unit repeats to invite yarn breakage, the whole efficiency of the spinning units will be considerably reduced. In this case, it is required that the particular spinning unit is separated from the centralized control system in order to repair or service the defective operation thereof. After the repair or service of the wrong spinning unit has been accomplished, it is for a second time connected to the centralized control system.

As will be obvious from the foregoing description, with the counter 290 which counts the number of times of failure to repair yarn breakage, the whole spinning efficiency will be further improved.

While this invention has been described in conjunction with specific embodiments thereof, it is evident that many alternatives, modifications and variations will be apparent to those skilled in the art. Accordingly, it is intended to embrace all alternatives, modifications and variations that fail within the spirit and broad scope of the appended claims.

What is claimed is:

1. A centralized control system for open end spinning machine comprising (a) a group control unit comprising (a-1) a first variable frequency power supply connected to a plurality of spinning units (a-2) a first spinning control means composed of a plurality of sequentially operated logical elements connected in series, said first spinning control means producing from the final-stage logical elements a command which is fed to said first power supply so as to increase the operational frequency of said power supply, said first spinning control means further producing from the respective logical elements parallel outputs each of which is fed to said spinning units so as to control the spinning operation thereof, (b) an individual control unit comprising (b-1) a second variable frequency power supply connected to a plurality of spinning units (b-2) a second spinning control means, which operates in response to a detecting signal of yarn breakage occurred in any one of said spinning units, composed of a plurality of sequentially operated logical elements connected in series, said second spinning control means producing from the final-stage logical elements a command which is fed to said second power supply so as to increase the operational frequency of said second power supply, said second spinning control means further producing from the respective logical elements parallel outputs each of which is fed to the spinning unit in which yarn breakage is occurred in order to control the starting state of the spinning operation during which operation the repair of yarn breakage is effected, (b-3) a synchronizing detecting means producing an output when the operational frequency of said second power supply in said individual control unit becomes equal to the operational frequency of said first power supply in said group control unit, (b-4) a switching means for changing the control of the spinning unit in which the repair of yarn breakage has been effected from said individual control unit to said group control unit in response to the output of said synchronizing detector, and (c) said plurality of spinning units each of which comprises (c-1) a spinning mechanism for rendering sliver of fibers spun to form a spun yarn and taking up the spun yarn onto a take-up means, (c-2) said spinning mechanism including a yarn breakage sensor provided in the stream of spun yarn, (c-3) a driving means for driving said spinning mechanism including a plurality of driving motors controlled by the output from said first or second variable frequency power supply, wherein when there is no yarn breakage in any one of the spinning units of the plurality, the spinning units are all controlled by said group control unit, while when there occurs yarn breakage detected by said yarn breakage sensor in any one of the spinning units of the plurality, only the spinning unit in which yarn breakage is occured is shifted from the control of said group control unit to the control of said individual control unit while the remaining spinning units in which no yarn breakage is occured remain under the control of said group control unit, and then after yarn breakage occured in the spinning unit is repaired under the control of said individual control unit, the spinning unit in which the repair of yarn breakage is effected is for a second time shifted to the control of said group control unit.

2. A centralized control system for open end spinning machine as defined in claim 1, which further comprises a braking unit supplying a braking command to said group control unit and said individual control unit.

3. A centralized control system for open end spinning machine as defined in claim 2, wherein each of said group control unit and said individual control unit further comprises a stop control circuit which is controlled by said braking unit.

4. A centralized control system for open and spinning machine as defined in claim 1, wherein said logical element provided in said group control unit and said individual control unit comprises a timer relay circuit.

5. A centralized control system for open end spinning machine as defined in claim 1, wherein each of said spinning units further comprises a control circuit for controlling said driving means.

6. A centralized control system for open end spinning machine as defined in claim 5, wherein said individual control unit further comprises a scanning circuit of which output is sequentially fed to each control circuit, whereby each of said driving means is controlled by the logical product of the output of said control circuit and the output of said scanning circuit.

7. A centralized control system for open end spinning machine as defined in claim 1, which further comprises a presetable counter which counts the number of times of failure to repair yarn breakage and renders an alarm operative when the number of times of the failure counted exceeds a predetermined value.

* * * * *